United States Patent [19]

Rikard et al.

[11] Patent Number: 4,660,752

[45] Date of Patent: Apr. 28, 1987

[54] VACUUM FEEDER FOR CONTINUOUS WEB

[75] Inventors: Luther O. Rikard, Linden; Mark A. Blackburn, Durand, both of Mich.

[73] Assignee: Compak/Webcor Manufacturing Packaging Co., Durand, Mich.

[21] Appl. No.: 770,783

[22] Filed: Aug. 29, 1985

[51] Int. Cl.[4] ..... B65H 5/02; B65H 20/08; B65H 29/24

[52] U.S. Cl. ..... 226/95; 226/170; 271/194; 271/196; 271/276

[58] Field of Search ..... 226/170, 171, 95, 97, 226/43, 45; 271/276, 194, 196

[56] References Cited

U.S. PATENT DOCUMENTS

| | | | |
|---|---|---|---|
| 3,140,030 | 7/1964 | Stewart | 226/95 |
| 3,425,610 | 2/1969 | Stewart | 226/170 X |
| 3,807,612 | 4/1974 | Eggert | 226/97 X |
| 4,285,507 | 8/1981 | Marinoff | 271/276 X |
| 4,294,539 | 10/1981 | Spehrley, Jr. | 226/95 X |
| 4,341,155 | 7/1982 | Relyea et al. | 226/43 X |

*Primary Examiner*—John M. Jillions
*Assistant Examiner*—Lynn M. Sohacki
*Attorney, Agent, or Firm*—Irvin L. Groh

[57] ABSTRACT

A vacuum feed mechanism for precision feeding a printed continuous double-backed corrugated paper board web to a platen die cutter for producing printed foldable box blanks. The feeder has several adjacent horizontal endless belts, with each belt having spaced cleats extending over the width of the belt facing outward and a row of holes between each cleat. A vacuum plenum extends through each belt with a lower wall containing longitudinal slots in registration with the belt holes. A suction fan removes air from the vacuum plenum producing air flow from the edges of the belts between adjacent cleats, through the belts and into the vacuum chamber to draw the belt into contact with the plenum chamber wall and the web in contact with the belt cleats, holding the web without slippage while the web is intermittently fed to the platen die cutter. The belt advancing mechanism utilizes separate drive pulleys for each belt keyed to a common shaft and separate idler pulleys freely rotating on another common shaft providing minimum inertia and permitting rapid starting and stopping of the belts for synchronized feeding of the web to the platen die cutter.

12 Claims, 5 Drawing Figures

Fig-3
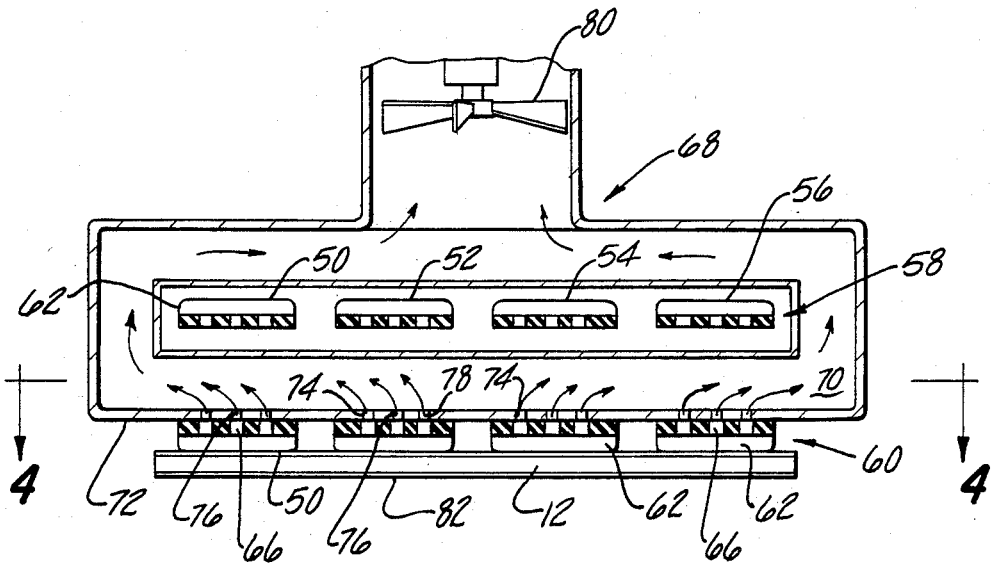
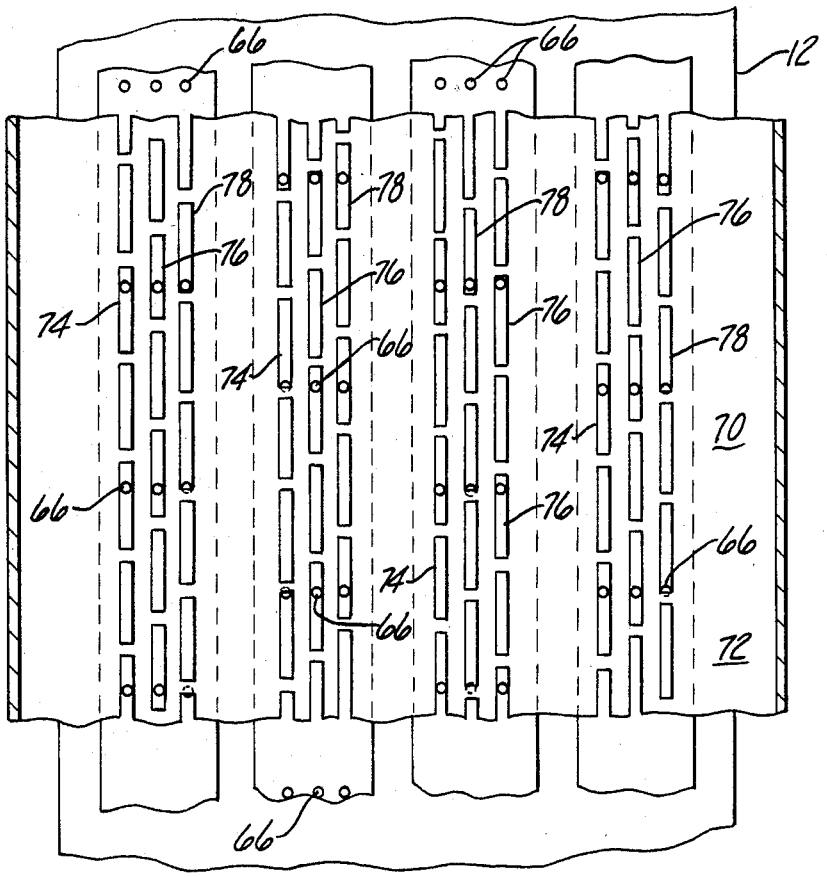
Fig-4

VACUUM FEEDER FOR CONTINUOUS WEB

This invention relates to apparatus for producing printed foldable box blanks for a printed continuous double-backed corrugated paper board web, and, more particularly to a vacuum feeder for feeding this web from an accumulator located at the exit end of a double-backed dryer to an intermittently operated platen die cutter.

Apparatus is shown in U.S. patent application, Ser. No. 456,550, filed Jan. 10, 1983, now U.S. Pat. No. 4,545,780 issued Oct. 8, 1985 which produces printed foldable box blanks in which a double-backed printed web is formed and fed to a platen die cutter by conventional feed means shown as a pair of pinch rolls. With the use of feed rolls, extreme care must be used to provide enough force to feed the web without slippage on the one hand, and not too much force to avoid crushing the corrugated board on the other hand. This is further complicated where the web being printed has been coated to provide a high quality printed surface, but the printing is subject to smearing when contacting rolls or other surfaces.

Vacuum conveying devices have been used in the paper board art. For example, U.S. Pat. No. 3,140,030 to Stewart shows a vacuum feeder used to draw corrugated paper board web through a double-backer. An endless belt acting as a continuous feeder engages the paper board from below. A second belt driven within the first belt coacts with the first belt to form vacuum chambers. This device is designed to continuously feed the web and necessarily engages the underside of the web with the upper run of the continuous belt.

U.S. Pat. No. 3,425,610 to Stewart also provides a vacuum feeder for advancing paper board. While this patent eliminates the dual belt system of the former Stewart patent, its structure is designed for continuous conveying where the top run of the belt is supported and engages the lower side of the paper board web.

It is an object of this invention to provide a vacuum belt feeder which will grip the paper board web for feeding the web to a platen die cutter which necessarily functions in an intermittent fashion as the web must be stationary at the instant the dies engage the web to crease and cut it into box blanks.

It is another object of this invention to provide an extremely stable adherence of the web to the vacuum conveying belt to maintain registry of the printed surface with the cutting dies. It has been found that instability and slippage between the web and belt occurs when the vacuum passages through the belt are blocked by the web being sucked into contact with the belt.

It is a still further object of this invention to reduce the mass of the components which must be rapidly started and stopped to provide intermittent feeding eliminating the tendency to overshoot or get out of synchronism by the inertia of the drive mechanism.

Still other objects and advantages will become apparent in the structure which accomplishes the foregoing objects by apparatus in the form of a plurality of endless belts having upper and lower runs disposed in a horizontal path. Each belt has cleats or ridges extending transversely across the width of the belt and protruding outwardly from the surface to define air flow paths between adjacent cleats. Aperture means is provided between each cleat in the form of a row of holes through the belt. Three holes provide adequate coverage even where one hole may be out of communication with the air flow path as it temporarily passes over supporting structure.

A vacuum plenum is located between the upper and lower runs of the belts having openings arranged in registration with the belt apertures. These openings typically take the form of longitudinally extending slots which cover from two to five belt holes in their longitudinal extent. The slot beginning and ends are staggered so that the supporting web between the ends of slots will not block more than one belt hole in any given passage between adjacent belt cleats. Typically four transversely spaced belts are used to provide minimal spacing from the edge of each belt to the air passage through the belts.

Evacuating means in the form of a suction fan is used to create a suction in the vacuum plenum inducing air flow from the edges of the belts through the air paths between adjacent cleats, through the belt apertures or holes and through the plenum openings or slots into the vacuum plenum itself to draw the web into contact with the cleats while maintaining a continuous air flow.

As set forth in the afore-mentioned patent application, Ser. No. 456,550, the printed surface of the paper board web exits from the double-backer facing downwardly. In order to minimize contact with this surface, the web is engaged on its top surface by the bottom runs of the endless belts. The vacuum acting through the elongated slots in the plenum wall draws the belts into contact with the plenum, supporting the weight of the lower runs of the belts.

The means for advancing the belts is in the form of separate drive pulleys, one for each belt, keyed to a common drive shaft and a plurality of idler pulleys, one for each belt, at the other end of the belts, mounted with individual bearings on a common idler shaft. The outer rims of both the drive pulleys and idler pulleys are crowned to keep the belts centered thereon. Both the idler pulleys and the drive pulleys are dished out on both faces from the rim to the central hub area which is recessed to reduce the total weight thereof. The drive shaft is connected to a drive motor through a brake-coupling mechanism in which the brake is actuated by a signal from a scanning device which detects the position of the printing on the web and stops the web in an aligned position in the platen die cutter. A switching mechanism on the die cutter actuates the coupling to move the web into the platen die cutter.

The reduced weight or mass of the drive and idler pulleys decreases the system inertia allowing the brake-coupling mechanism to accurately start and stop the web in synchronization with the movement of the platen die cutter.

The objects of the invention are accomplished by the embodiment disclosed in the following description and illustrated in the drawing in which:

FIG. 3 is a sectional end view of the vacuum feeder of this invention taken along line 3—3 of FIG. 1;

FIG. 4 is a sectional view taken along line 4—4 of FIG. 3 showing the bottom face of the plenum chamber in plan view and the relationship of the plenum openings or slots to the belt apertures or holes.

Figure 1:
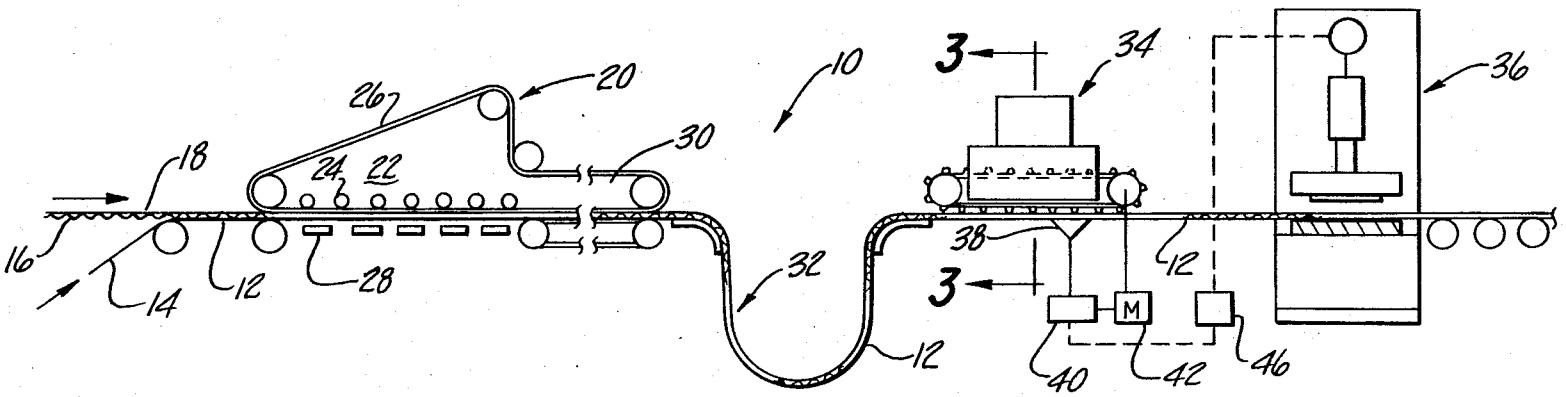
FIG. 1 is a diagrammatic view of a portion of the apparatus for continuously forming foldable box blanks starting with the joining of the printed web to a single-backed web through the double-backer and accumulator loop to the vacuum feeder of this invention to a platen die cutter.

In FIG. 1, a corrugated paper board line 10 is shown for producing foldable box blanks. A double-backed web 12 is formed by pressing printed web 14, with its printed side 14 facing downward, against the crests 16 of corrugated single-backed web 18 to which adhesive has been applied. The double-backed web 12 enters double-backer 20 in which the glue is set in a heating zone 22 under the pressure of rollers 24 and felt 26 pressing the web 12 against the top surface of heating platens 28. The web exits through cooling zone 30 to form a loop in accumulator station 32 as it is next fed into the vacuum feeder 34 of this invention. Vacuum feeder 34 engages the top surface of web 12 and feeds it intermittently in synchronization with the folding and cutting platen die press 36. The registration of the printing is sensed by scanner 38 which actuates through control 40 a brake-coupling mechanism 42 supplying power from motor 44 for advancing feeder 34. The brake portion of mechanism 42 is actuated by the signal from scanner 38 to stop the web 12 in platen press 36 as the dies are advanced to cut and crease the web in its stationary state to produce a box blank. A signal from proximity switch 46 on platen die cutter 36 actuates the coupling of mechanism 42 through control 40 to advance the web into the platen press 36.

Figure 2:
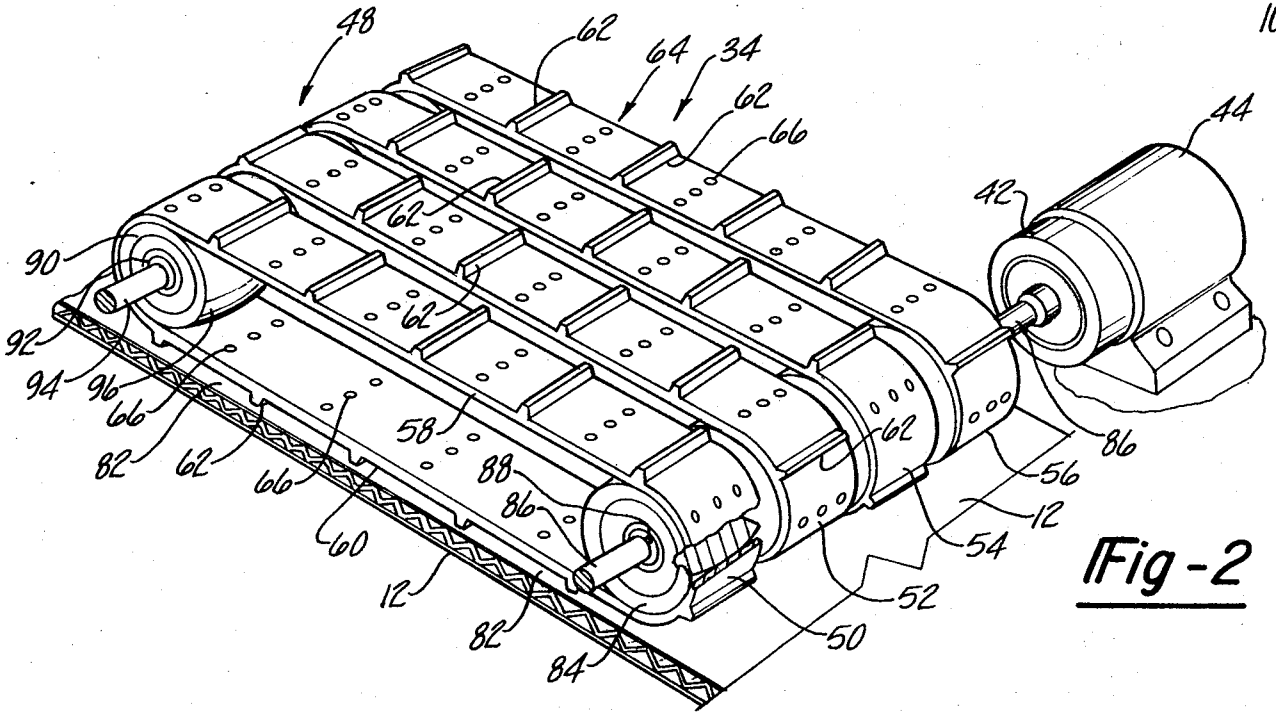
FIG. 2 is a perspective view showing the interrelationship of the four vacuum belts and their separate drive and idler pulleys and particularly showing the cleats and air passages formed thereby of this invention.

As can be seen in FIG. 2, the vacuum feeder 34 employs an endless belt means 48 having a plurality of individual belts 50, 52, 54 and 56 which are transversely spaced with upper runs 58 and lower runs 60 disposed in a horizontal path. Each belt has a plurality of evenly spaced outwardly protruding cleats 62 extending transversely across the width of the belts. Aperture means 64 in the form of a row of three holes 66 are located between each cleat 62.

Vacuum chamber 68, not shown in FIG. 2 for clarity, is formed in the shape of a donut having a lower passage portion 70 which cooperates with the lower runs 60 of belts 50, 52, 54 and 56 while the upper runs 58 of these belts pass through the open space of the donut-shaped plenum 68. Lower plenum wall 72 contains longitudinally extending slots 74, 76 and 78 which are arranged in registration with the aperture means 64 or holes 66 of the belts. The ends of adjacent slots 74, 76 and 78 are staggered so that at least two holes 66 in any row of three are in registration with a slot to provide adequate air flow.

In operation, evacuating means, in the form of suction fan 80, draws air from vacuum plenum 68 causing air to flow from the edges of each belt 50, 52, 54 and 56 through passage ways 82 between adjacent cleats 62 through the belt apertures 66 and plenum wall slots 74, 76 and 78 into vacuum plenum 68. This air flow draws the lower runs 60 of belts 50, 52, 54 and 56 into contact with lower plenum wall 72 and the web 12 into contact with the cleats 62 to transport web 12 without slipping relative to belts 50, 52, 54 and 56. This vacuum transport of the web 12 has no tendency to crush the corrugated paper board or interfere with the printed face 14 of web 12.

In a typical application, the paper board width may be of the order of 36 inches with the individual belt width being approximately six inches. The cleats 62 and the belt aperture 64 can be on two inch centers with the apertures 64 being one inch diameter holes. The overall length of the dryer belts can be of the order of three feet.

The means for advancing the belts to intermittently feed the platen press 36 include individual drive pulleys 84 for each belt keyed to a common drive shaft 86 by keys 88. Similarly, individual idler pulleys 90 carry the other end of the belts and are mounted with bearings 92 on a common shaft 94.

Figure 5:
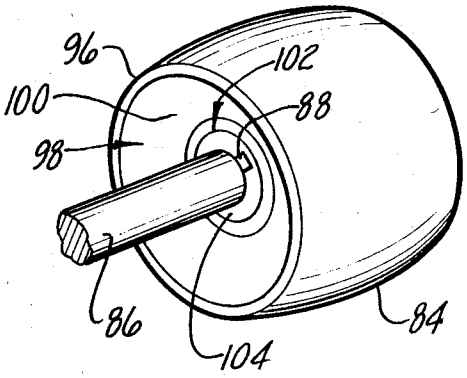
FIG. 5 is a perspective view showing the construction of the drive and idler pulleys specifically showing a drive pulley keyed to the drive shaft.

As shown in FIG. 5, the drive pulleys and the idler pulleys are constructed in a similar fashion with convex or crowned rims 96 and dished out faces 98. The crowned rims provide a centering action for the individual belts. The faces 98 are dished out to provide a central web 100 between the pulley rim 96 and its central hub 102. In the case of the drive pulleys 84, the central hub 102 is in the form of a bushing 104 receiving the drive shaft 86 and key 88. In the case of the idler pulley 90, the central hub 102 is in the form of a roller bearing 92 receiving idler shaft 94. This pulley construction minimizes the weight or mass of the overall system to provide low inertia permitting rapid starting and stopping of the belts and synchronization with the reciprocation of the platen die cutter 36.

The embodiments of the invention in which an exclusive property or privilege is claimed are defined as follows:

1. Apparatus for precision advancement of a continuous web comprising, in combination:

a longitudinally extending endless belt means having upper and lower runs disposed in a horizontal path, said belt means having a plurality of adjacent uninterrupted, outwardly facing, planar surfaces, spaced along the circumference of said belt means the longitudinal extend of each of said planar surface terminating in an outwardly extending cleat extending transversely across the width of said belt means defining with said web separate unobstructed air flow paths, each said cleat extending entirely transversely across said belt means, aperture means in each of said planar surfaces passing through said belt means for the passage of air therethrough;

a vacuum plenum located between the upper and lower runs of said belt means, said plenum including wall means having openings arranged in registration with said aperture means;

evacuating means for creating a suction in said vacuum plenum inducing air flow from the edges of said belt means through said air paths, said belt apertures and plenum openings into said vacuum plenum to draw said web into contact with said cleats;

means for advancing said belt means to move said web and wherein the area of contact between each cleat and the web is substantially less than the area of each outwardly facing planar surface.

2. Apparatus according to claim 1 wherein said belt means includes a plurality of parallel, transversely spaced belts with said cleats extending over the width of each belt.

3. Apparatus according to claim 2 wherein said plenum wall means is arranged with said openings aligned with the aperture means on the lower runs of said belts and said web is drawn into contact with the cleats on said lower belt runs.

4. Apparatus according to claim 2 wherein said aperture means includes a row of holes parallel to and between each cleat.

5. Apparatus according to claim 4 wherein there are three holes in each row.

6. Apparatus according to claim 4 wherein said openings are in the form of slots having longitudinal extent encompassing holes in at least two adjacent rows of belt holes.

7. Apparatus according to claim 6 wherein said plenum wall means is arranged with said slots aligned with the holes on the lower runs of said belts whereby said belts are drawn into contact with said plenum wall means and said web is drawn into contact with the cleats on said lower belt runs.

8. Apparatus according to claim 2 wherein said belt advancing means include a plurality of drive pulleys, one for each belt, keyed to a common drive shaft and a plurality of idler pulleys, one for each belt.

9. Apparatus according to claim 8 wherein said idler pulleys are mounted with individual bearings on a common idler shaft.

10. Apparatus according to claim 9 wherein said drive pulleys and said idler pulleys have crowned rims to maintain said belts centered thereon.

11. Apparatus according to claim 9 wherein said web is printed and further including scanning means for intermittently actuating said belt advancing means in synchronization with said printing.

12. Apparatus according to claim 11 wherein said belt advancing means moves said web into a platen die cutter and further includes a belt drive motor and a brake-coupling mechanism operatively connecting said belt drive motor to said drive shaft and wherein said brake is actuated by a signal from said scanning means to stop the web in said platen die cutter and a switching mechanism on said die cutter actuates said coupling to move said web into said platen die cutter.

* * * * *